US005451323A

United States Patent [19]

Akao et al.

[11] Patent Number: 5,451,323

[45] Date of Patent: Sep. 19, 1995

[54] METHOD FOR RECOVERING AND REPRODUCING TINNING LIQUID

[75] Inventors: Kenichiro Akao; Hajime Ogata; Toshihiro Kikuchi; Kazuo Mochizuki; Koji Yamato, all of Chiba, Japan

[73] Assignee: Kawasaki Steel Corporation, Kobe, Japan

[21] Appl. No.: 219,290

[22] Filed: Mar. 28, 1994

[30] Foreign Application Priority Data

Apr. 22, 1993 [JP] Japan ..... 5-095849

[51] Int. Cl.[6] ..... B01D 15/04

[52] U.S. Cl. ..... 210/665; 204/DIG. 13; 205/99; 205/300; 210/670; 210/688

[58] Field of Search ..... 210/665, 668, 670, 688; 205/99, 140, 300; 204/DIG. 13

[56] References Cited

U.S. PATENT DOCUMENTS 4,006,213 2/1977 Fisher et al. ..... 205/140

4,219,390 8/1980 Stuart ..... 210/688

*Primary Examiner*—Ivars Cintins

*Attorney, Agent, or Firm*—Staas & Halsey

[57] ABSTRACT

A method of recovering and reproducing a tinning liquid containing Fe ions and other detrimental cations by the steps of removing cations from the tinning liquid by passing the tinning liquid or a diluted liquid of the tinning liquid through a strong-acid cation exchange resin to obtain a recovered acid, thereafter reproducing the strong-acid cation exchange resin and desorbing adsorbed cations into a solution containing an acid by passing the acid through the exchange resin to which the cations have been adsorbed, precipitating and separating Sn ions in the form of a precipitate of an Sn compound from the solution into which the cations have been desorbed while maintaining Fe ions as ions in this solution, mixing and dissolving the precipitate of the Sn compound or a compound reduced from the same in the recovered acid to reproduce and reuse the mixture of the Sn compound and the recovered acid as a tinning liquid, and discharging the solution containing Fe ions out of the system of the tinning liquid.

8 Claims, 2 Drawing Sheets

METHOD FOR RECOVERING AND REPRODUCING TINNING LIQUID

BACKGROUND OF THE INVENTION

1. Field of the Invention

This invention relates to a method of removing Fe ions and other detrimental cations accumulated in a tinning liquid and in a water washing bath after tinning to recover and reproduce the tinning liquid and useful materials, such as a plating electric conduction assistant and tin, for reuse.

2. Description of the Related Art

Electric tinning processes are generally grouped into alkali lines and acid lines. A halogen bath, a ferro-stann-bath or the like is ordinarily used as a plating bath in acid lines. Recently, an organic acid (alkanesulfonic acid, alkanolsulfonic acid) bath with which an increase in current density and insoluble anodization can be achieved has come into use. In recent years, however, the problem of environmental pollution has attracted more attention, and regulations on disposal of waste liquids have become stricter. For this reason and because of a high price of available acid baths, a need to reduce the amount of waste liquid by forming a plating line as a closed system has arisen. Also, it is a common practice to add various expensive organic additives to a plating liquid for the purpose of improving the current efficiency and the plated appearance. Also for prevention of losses of such expensive additives in a plating liquid, recovery of the plating liquid is indispensable.

However, it has been found that as the operation of recovering the entire or a part of a waste liquid and returning the recovered liquid to a plating bath in a closed system continues, various impurities accumulate in the plating liquid and this badly influences the plating quality. In an open system such impurities are discharged out of the system along with a waste liquid. In particular, Fe ions accumulate in the tinning liquid by dissolution during predipping of a plating member to be plated (steel plate or band) in an acid tinning bath and electro-depositing metal tin to the surface of the plated member, by introduction of an acid-cleaning water-wash liquid of a pretreatment step into the plating liquid and by other causes.

$Fe^{2+}$ ions in a plating liquid are changed into $Fe^{3+}$ ions by air oxidation or anodic oxidation of an insoluble anode, as represented by the following formula (1):

$$Fe^{2+}+\tfrac{1}{4}O_2+\tfrac{1}{2}H_2O \rightarrow Fe^{3+}+OH \quad (1)$$

However, if Sn ions exist in the plating liquid, $Fe^{3+}$ ions oxidize Sn ions by a reaction as represented by the following formula (2)

$$2Fe^{3+}+Sn^{2+} \rightarrow 2Fe^{2+}+Sn^{4+} \quad (2)$$

$Sn^{4+}$ ions generated in this manner precipitate in a sludge ($SnO_2$). Therefore, it can be considered that substantially no $Fe^{3+}$ ions exist in the tinning liquid and that all the Fe ions are mainly $Fe^{2+}$ ions. It can also be considered that the amount of $Sn^{4+}$ is very small and that all the Sn ions are mainly $Sn^{2+}$ ions. Thus, if $Fe^{2+}$ ions exist in the tinning liquid, $Sn^{2+}$ ions are oxidized to cause a sludge and the loss of precious tin is large.

According to an experiment made by the inventors of the present invention, it is known that the oxidizing velocity of $Sn^{2+}$ is proportional to the square of the $Fe^{2+}$ concentration. If the Fe ion concentration in a plating liquid is increased, the amount of generated sludge is sharply increased and serious problems of tin loss and of deterioration in plated surface configuration caused by contact with a contamination of the plating line and the sludge are encountered. In the case of a high-speed plating line, in particular, the oxidation of a plating liquid is promoted by involvement of air and such problems therefore become more considerable. Accordingly, a need to specially remove and control Fe ions in the plating liquid arises. Such problems are unnoticed if a low-cost bath such as a halogen bath is used and if the plating liquid is removed as a waste. In recent years, however, organic acid baths of a high unit bath cost have come into use, which are adopted for the purpose of improving the plating performance. If such baths are used, the method of renewing plating liquid by removing the plating liquid as waste is not economical. Therefore, a need for a method of reproducing a plating liquid has arisen.

If Sn ions and detrimental cations such as Fe ions coexist in a tinning liquid in any process, Sn ions are captured with priority while other detrimental ions, i.e., Fe ions and the like, cannot be removed and remain in the tinning liquid. Therefore, a method of removing Sn ions in a plating bath by some pretreatment and thereafter removing Fe ions and other detrimental cations remaining in the plating bath is generally suitable and has been accepted as a basic idea. Processes based on this method have been proposed as described below.

Japanese Patent Publication No. 57-53880 discloses a method of recovering Sn ions in a tinning liquid by using a chelate resin having a property of selectively adsorbing Sn ions and thereafter removing Fe ions and other cations by using a strong-acid cation exchange resin. In this patent, a recovered acid (the same acid as a plating electric conduction assistant) obtained by the chelate resin treatment is used to desorb Sn ions adsorbed to the chelate resin. It is therefore apparent that an amount of the acid (plating electric conduction assistant) larger than the recovered amount is required to sufficiently desorb the adsorbed ions and to promote the exchange reaction on the desorption side. The acid content in the recovered tinning liquid finally obtained is larger than the plating liquid before the Fe removing treatment because a large amount of the acid is passed through the chelate resin to stably desorb Sn ions therefrom. The recovered liquid, therefore, cannot be directly returned to the plating bath and it is necessary to remove excess acid by some means. Also, since an expensive plating electric conduction assistant must be used for Sn ion desorption, the process cost is increased. The equipment cost is increased by the provision of two necessary resin columns.

Japanese Patent Publication No. 61-17920 discloses a method of electrolytically precipitating and removing Sn ions by electrolysis of a tinning liquid and thereafter removing Fe ions and other cations by passing the remaining liquid through an H-type cation exchange resin. However, if this method is used, additives and the like in the plating liquid are anode-oxidized by electrolysis. Also, if a dragged-out liquid is processed or if the Sn ion concentration is extremely low, the electrolysis efficiency is reduced, resulting in an increase in process cost. Moreover, a troublesome operation for maintenance of the electrolytic precipitation cathode is required and Sn ions lost by electrolysis must be resupplied. Thus, this method is economically disadvantageous.

As described above, if a process in which Sn ions are selectively captured and Fe ions and other cations are thereafter removed is used, Sn ions captured by the chelate resin method or the electrolytic precipitation method cannot be efficiently recovered. Therefore, the overall operability and economy of the process are reduced by the recovery step. Moreover, excess acid is mixed in the reproduced plating liquid and Sn ions are lost by electrolysis, so that the material balance is lost. The operation of such a process cannot be repeatedly performed because the composition of the plating liquid becomes different from the original composition during repeated operation. Thus, no methods have been developed which ensure that an acid tinning bath can be continuously reproduced, and there is a demand for a process improved in economy as well as operability.

SUMMARY OF THE INVENTION

In view of these problems, an object of the present invention is to improve the environmental hygiene, the economy and the operability of a process of recovering and reproducing a tinning liquid.

Another object of the present invention is to provide a method of removing Sn ions, Fe ions and other detrimental cations accumulated in a tinning liquid to reproduce and reuse the tinning liquid at a low cost as well as to recover and reproduce useful materials such as a plating electric conduction assistant and tin.

Still another object of the present invention is to provide a method which enables a tinning liquid to be repeatedly reproduced.

To achieve these objects, according to the present invention, there is provided a method of recovering and reproducing a tinning liquid containing Sn ions, Fe ions and detrimental cations by the steps of:

(a) absorbing Sn ions, Fe ions and detrimental cations from tinning liquid by passing one of tinning liquid and a diluted tinning liquid through a strong-acid cation exchange resin to obtain a recovered acid;

(b) thereafter reproducing the strong-acid cation exchange resin and desorbing the adsorbed Sn ions, Fe ions and detrimental cations into a solution containing an acid by passing the acid through the exchange resin to which the Sn ions, Fe ions and detrimental cations had been adsorbed;

(c) precipitating and separating Sn ions in the form of a precipitate of an Sn compound from the solution obtained in the step (b) while maintaining Fe ions and detrimental cations as ions and detrimental cations, respectively, in the solution;

(d) mixing and dissolving the precipitate of the Sn compound obtained in the step (c) in the recovered acid obtained in the step (a) to reproduce and reuse the mixture of the Sn compound and the recovered acid as tinning liquid; and (e) discharging the solution, obtained in the step (c) and containing Fe ions and detrimental cations, out of the system of the tinning liquid.

Other objects and features of the present invention will become apparent from the following detailed description of the invention.

DESCRIPTION OF THE PREFERRED EMBODIMENT

Figure 1:
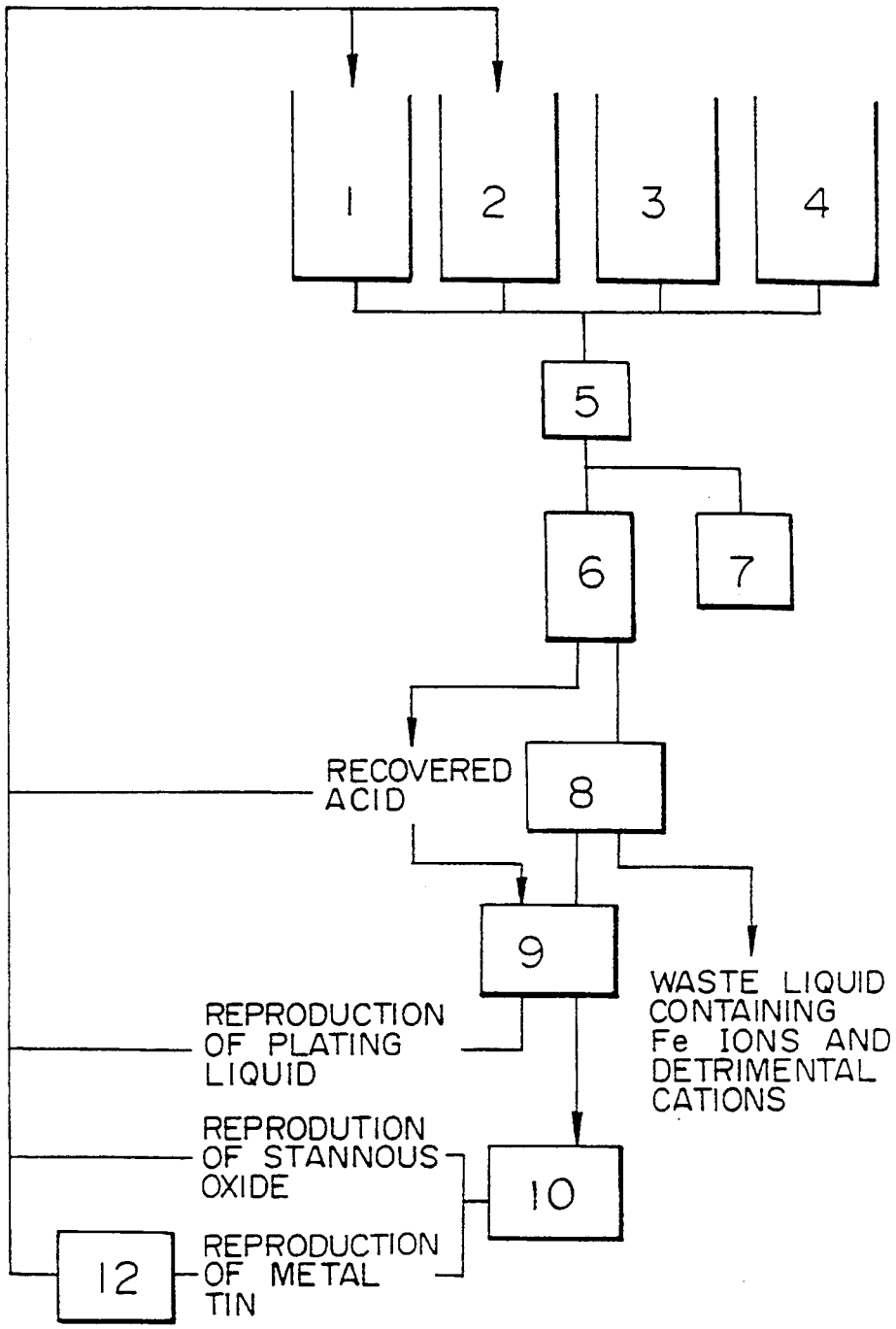
FIG. 1 is a flow diagram of a process of removing Sn ions, Fe ions and detrimental cations and reproducing a plating liquid to form a closed system of tinning facilities.

The present invention will be described below in detail.

In accordance with the present invention, a tinning liquid, a dragged-out liquid after tinning, a water washing liquid or a mixture of these liquids is first passed through a strong-acid cation exchange resin. The undiluted plating liquid may be passed through the exchange resin. However, it is desirable to mix, if possible, the undiluted plating liquid with the dragged-out liquid or the water washing liquid in order to increase the pH value of the passed liquid, because the adsorption performance is reduced if the tinning liquid is strongly acidic. The filtered liquid passed through the exchange resin can be used as a recovered acid containing additives for plating liquid regulation and for other purposes.

The cation exchange resin to which cations such as Sn ions, Fe ions and detrimental cations have been adsorbed can be reproduced by desorbing and recovering the cations by passing an acid through the exchange resin. The acid used for desorption is not necessarily the same as a plating electric conduction assistant, and a cheaper acid such as sulfuric acid or hydrochloric acid can be used. The concentration of the acid is, preferably, about 10 to 30 w/v %. Further, the liquid may be suitably filtered before being passed through the exchange resin for the purpose of preventing a suspended matter in the plating liquid from depositing on the exchange resin, preventing a deterioration in the performance of the exchange resin and extending the life of the exchange resin. The method of operating the ion exchange column is not particularly limited and may be an ordinary method.

The solution obtained bypassing the acid through the cation exchange resin contains Sn ions, Fe ions and detrimental cations and there is a need to separate Sn ions from this solution.

To provide a process capable of repeated operation in accordance with the present invention, the step of selectively capturing Sn ions, which relates to the problems of the conventional processes, was reexamined. Two methods effective in solving the problems were thereby thought out. One of them is based on a finding with respect to conditions for generation of hydroxides of Sn, Fe and detrimental cations, which have not been examined, i.e., a finding that if the pH value of an acid solution in which Sn ions, Fe ions and detrimental cations coexist is increased, an Sn hydroxide precipitate is first formed in the range equal to or higher than pH 3 and the formations of Fe and detrimental cations hydroxide precipitate are started when pH 6 is reached.

According to a document, Atlas of Electrochemical Equilibria by M. Pourbaix, (1966), p. 312, p. 478 Pergamon Press, an Sn hydroxide precipitate is formed at pH 1 or higher and an Fe hydroxide precipitate is formed at pH 6 or higher. However, the solubility of Fe hydroxide precipitates is lower than that of Sn hydroxide precipitates, and behaviors of such hydroxides in a coexisting solution are unknown. The formed Sn hydroxide precipitate can be completely dissolved after being separated if an acid is added to the precipitate to reduce the pH value after the separation. This method of controlling the pH value to recover captured Sn ions in this manner is much more advantageous than the conventional method since it ensures that the Sn ion recovery rate can be increased substantially to 100%. That is, the material balance is maintained in one process cycle, so that the plating liquid composition is not changed even during repeated operation. Addition of an alkali or an acid may suffice to increase or reduce the pH value. Both the system and the operation can be simpler and the system can be arranged so as to be maintenance-free. This method is further advantageous in terms of economy.

This method, however, cannot be directly applied to the conventional Sn removing step, because if the pH value of a plating liquid is increased, a loss of an acid, i.e., a precious plating electric conduction assistant, is caused by the neutralization reaction.

Therefore, the inventors thought over the process configuration again and found that a step of first recovering an acid is required, that is, in this method, the efficiency of selective capturing of Sn ions and recovery of captured Sn ions can be improved by a pH control. Also, a feature of the present invention, realizing an application of this method from a conception utterly different from that in the conventional art, resides in that a process step of simultaneously capturing Sn ions, Fe ions and detrimental cations in a plating liquid is used as a pretreatment. That is, cations are entirely removed to recover an acid, Sn ions are thereafter captured selectively by using the pH regulation method and the recovered acid is added to an Sn precipitate, whereby substantially 100% Sn ions are recovered.

This process is advantageous in that the reproduced plating liquid can be reused without substantially changing the composition thereof.

This method is not particularly limited but sodium hydroxide, for example, may be added. A pH meter may be used for the pH control.

The precipitated tin hydroxide can be recovered to be reused as a tinning bath tin ion supply source. It may be reused to obtain a reproduced plating liquid by a method of dissolving the precipitate by adding an acid (which is, preferably, the plating electric conduction assistant, if possible) to the precipitate.

If tin in the hydroxide is quadrivalent, an insoluble tin sludge is formed. In such a case, the precipitate may be reduced. For reduction, a method of heating the precipitate in a hydrogen or carbon monoxide atmosphere may be used. If tin is recovered in the form of stannous oxide by being reduced incompletely, it can be directly introduced into the plating liquid to resupply Sn ions. Also, as disclosed in Japanese Patent Publication No. 61-46528, the sludge may be placed in a reducing atmosphere to obtain metal tin. Because metal tin in the obtained state is not dissolved, it is bivalently oxidized by a separate dissolution apparatus to be dissolved as Sn ions in the plating liquid. Alternatively, the sludge may be reduced and dissolved in the form of metal tin, stannous oxide or Sn ions in the plating liquid by a reduction apparatus.

In the second method for capturing Sn ions, the above-mentioned solution containing Sn ions is processed by an oxidation treatment to oxidize $Sn^{2+}$ ions to form an $SnO_2$ sludge. On the other hand, Fe ions do not form any precipitate in the acid range. It is therefore possible to separate only tin from a filtered liquid. For the oxidation treatment, any method using a chemical or a gas, e.g., a method of introducing air or oxygen in a blowing manner or adding a hydrogen peroxide solution may be used. A sludge formed by this oxidation method can also be reduced by the same method as that described above. The separated tin sludge may be reduced to recover and reproduce tin in the form of stannous oxide or metal tin by the same method as that described above, although the precipitation separation of tin is not limited to the above-described method.

The acid containing Fe ions may be discharged as a waste liquid immediately or after being further processed.

The present invention will be further described with reference to the drawings.

FIG. 1 is a flow diagram of an example of a process of the present invention. Plating liquids in tinning baths 1 and 2 and liquids in a drag-out bath 3 and a water washing bath 4 are mixed and are filtered through a cartridge filter 5 to remove suspended matters. Thereafter, the mixture liquid is first passed through a strong-acid cation exchange resin column 6. By passage through the exchange resin column 6, cations such as Sn ions and Fe ions are removed and a recovered acid containing additives is obtained. Next, a sulfuric acid solution from a sulfuric acid tank 7 is passed through the exchange resin column 6 to reproduce the exchange resin and to desorb adsorbed Sn ions, Fe ions and detrimental cations into the sulfuric acid solution. This sulfuric acid water solution is supplied to a pH regulation bath 8 and is processed in the same by addition of sodium hydroxide to precipitate and remove only formed tin oxides. The pH value of the solution is continuously measured with a pH meter (not shown) while the liquid introduction rate is controlled, whereby the pH value of the solution is maintained in the range of about 3 to 6, more preferably, 3.5 to 4.5.

The separated tin hydroxides are mixed and dissolved in the recovered acid in a dissolution bath 9 to form a reproduced plating liquid. Insoluble tin components not dissolved are reduced in a reduction unit 10 to be reproduced as stannous oxide or metal tin. Stannous oxide is directly dissolved and recovered as Sn ions in the plating liquids while metal tin is bivalently oxidized in a dissolution unit 12 to be also dissolved and recovered as Sn ions in the plating liquids. On the other hand, the sulfuric acid water solution containing Fe ions is discharged as a waste immediately or after being neutralized. The mixture liquid may be passed through the cation exchange resin at spatial velocities (SV) 1 to 10. In this system, Fe ions are removed from the plating liquids while an expensive plating electric conduction assistant (acid) and tin are recovered.

Figure 2:
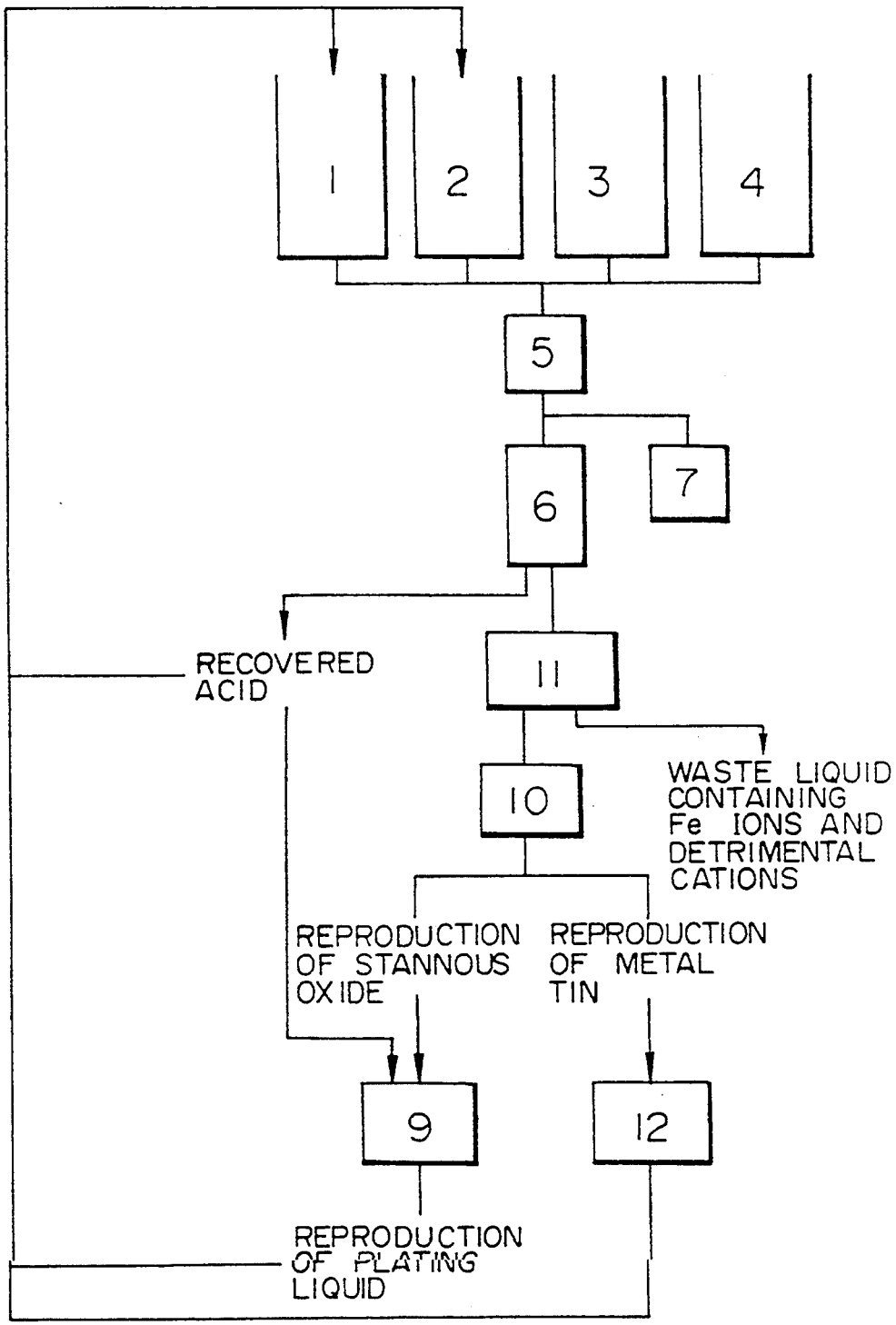
FIG. 2 is a flow diagram similar to FIG. 1, showing another example of the present invention.

FIG. 2 is a flow diagram of another example of the process of the present invention. Plating liquids in tinning baths 1 and 2 and liquids in a drag-out bath 3 and a water washing bath 4 are mixed and are filtered through a cartridge filter 5 to remove suspended matters. Thereafter, the mixture liquid is first passed through a strong-acid cation exchange resin column 6. By passage through the exchange resin column 6, cations such as Sn ions and Fe ions are removed and a recovered acid containing additives is obtained. Next, a sulfuric acid solution from a sulfuric acid tank 7 is passed through the exchange resin column 6 to reproduce the exchange resin and to desorb adsorbed Sn and Fe ions into the sulfuric acid solution. This sulfuric acid water solution is supplied to an oxidation bath 8 to undergo an oxidation treatment. Only a tin sludge thereby formed is precipitated and removed. The separated sludge further undergoes a reduction treatment in a reduction unit 10 to be reproduced stannous oxide or metal tin. The obtained stannous oxide is mixed with the recovered acid in a dissolution bath 9 to form a reproduced plating liquid. The metal tin is oxidized in a dissolution unit 12 to be dissolved and recovered as Sn ions in the plating liquids, as in the process shown in FIG. 1. On the other hand, the sulfuric acid water solution containing Fe ions is discharged as a waste after being neutralized. The mixture liquid may be passed through the cation exchange resin at spatial velocities (SV) 1 to 10. In this system, Fe ions are removed from the plating liquids while an expensive plating electric conduction assistant (acid) and tin are recovered substantially entirely in the form of ions, thereby maintaining the material balance and enabling continuous operation.

(EMBODIMENTS)

solution) was then added to the sulfuric acid solution passed through the exchange resin and containing Sn ions and Fe ions so that the pH value of solution was 4, thereby obtaining a tin hydroxide precipitate. This precipitate was separated and mixed with the recovered acid to obtain about 0.1 $m^3$ of a reproduced plating liquid. A tin component constituting a sludge without being dissolved was collected and was maintained in air at 600° C. for 1 hour to burn off impurities. Successively, the sludge was maintained in a reducing atmosphere (containing 10% hydrogen and the balance nitrogen) at 850° C. for 50 hours. One (1.0) kg of stannous oxide was thereby recovered and was pulverized into a powder, which was thrown into and dissolved in the plating liquids to recover tin.

Table 1 shows changes in the contents of Sn ions and Fe ions and the acid amount in the processed liquids, and Table 2 shows exchange resins used in this embodiment.

TABLE 1

| EXAMPLES OF INVENTION | BEFORE TREATMENT | | | | COMPOSITION OF RECOVERED ACID | | | |
|---|---|---|---|---|---|---|---|---|
| | $Sn^{2+}$ (kg) | $Fe^{2+}$ (kg) | $Cr^{3+}$ (kg) | ACID AMOUNT (kg) | $Sn^{2+}$ (kg) | $Fe^{2+}$ (kg) | $Cr^{3+}$ (kg) | ACID AMOUNT (kg) |
| EXAMPLE 1 | 3 | 1 | — | 10 | 0 | 0.1 | — | 10 |
| EXAMPLE 2 | 3 | 2.1 | — | 13.3 | 0 | 0 | — | 13.3 |
| EXAMPLE 3 | 4.5 | 3 | — | 15 | 0 | 0.1 | — | 15 |
| EXAMPLE 4 | 2.1 | 1.2 | — | 8 | 0 | 0.1 | — | 8 |
| EXAMPLE 5 | 3.5 | 1.5 | 0.3 | 7.5 | 0 | 0.1 | 0 | 7.5 |
| COMPARATIVE EXAMPLE 1 | 3 | 2 | — | 10 | 0 | 2 | — | 10 |
| COMPARATIVE EXAMPLE 2 | 3 | 1.5 | — | 10 | 0 | 0 | — | 10 |

| EXAMPLES OF INVENTION | COMPOSITION OF LIQUID AFTER pH ADJUSTMENT TREATMENT | | | AMOUNT OF REMOVED IRON (kg) | AMOUNT OF REMOVED CHROMIUM (kg) | AMOUNT OF RECOVERED PLATING LIQUID ($m^3$) | AMOUNT OF RECOVERED STANNOUS OXIDE (kg) |
|---|---|---|---|---|---|---|---|
| | $Sn^{2+}$ (kg) | $Fe^{2+}$ (kg) | $Cr^{3+}$ (kg) | | | | |
| EXAMPLE 1 | 0 | 0.9 | — | 0.9 | — | 0.1 | 0.1 |
| EXAMPLE 2 | 0 | 2.1 | — | 2.1 | — | 0.1 | 0.1 |
| EXAMPLE 3 | 0 | 2.9 | — | 2.9 | — | 0.1 | 0.2 |
| EXAMPLE 4 | 0 | 1.1 | — | 1.1 | — | 0.1 | 0.2 |
| EXAMPLE 5 | 0 | 1.4 | 0.3 | 1.4 | 0.3 | 0.1 | 0.1 |
| COMPARATIVE EXAMPLE 1 | 0 | 0 | — | 0 | — | — | — |
| COMPARATIVE EXAMPLE 2 | 0 | 0 | — | 0 | — | — | — |

The present invention will be described with respect to the following embodiments thereof.

(Embodiment 1)

Fe ions and other cations in a tinning liquid were removed by using the system shown in FIG. 1. The tinning liquids used in Examples 1 to 3 of the invention were liquids containing i-propanolsulfonic acid, Sn ions, Fe ions and plating additives. In Example 4 to 5, phenolsulfonic acid was used in place of i-propanolsulfonic acid.

An amount of 0.1 $m^3$ of a mixture of the plating liquid and a dragged-out liquid (acid concentration: 0.5 kmol/$m^3$, acid amount (in sulfuric acid equivalent): 10 kg) was passed through cartridge filter 5 and was thereafter passed through 0.08 $m^3$ of a strong-acid cation exchange resin (Diaion SK1B, a product from Mitsubishi Kasei Corp.) at spatial velocity SV4 to remove cations. Ten (10) kg of a recovered acid was thereby obtained. The exchange resin to which cations were adsorbed was reproduced by passing 0.2 $m^3$ of a 10 w/v% of a sulfuric acid solution through the exchange resin. About 0.3 $m^3$ of sodium hydroxide (1N water In each of Examples 1 and 4 of the invention, a liquid approximately equal in concentration to the undiluted liquid was passed through the cation exchange resin and Fe ions and other cations were thereby removed efficiently to obtain a recovered acid. Also, 10% sulfuric acid was passed through the exchange resin to reproduce the exchange resin as well as to obtain a sulfuric acid water solution containing Sn ions and Fe ions. Further, sodium hydroxide was added to this water solution to precipitate and separate Sn ions in the form of tin hydroxides, and the tin hydroxide precipitate was mixed and dissolved in the recovered acid, thereby obtaining a reproduced plating liquid. The insoluble tin component was burnt in air to burn off impurities and was reduced in a reducing atmosphere to recover stannous oxide. The mass of stannous oxide was pulverized into a powder and was thrown into and dissolved in the plating liquids to recover tin.

In Example 5, $Cr^{3+}$ ions ($Cr^{6+}$ ions oxide $Sn^{2+}$ ions and reduce to form $Cr^{3+}$ ions) which were mixed in the plating liquid were removed, as in the case of $Fe^{2+}$ ions.

In Examples 2 and 3 of the invention, liquids respectively diluted 3 times and 10 times with pure water (the amounts of which were 0.3 and 1.0 $m^3$, respectively) were passed through the cation exchange resins. As a result, the amount of cations adsorbed to the exchange resin was increased in comparison with Example 1.

Also, the recovered acid, the reproduced plating liquids and stannous oxide could be obtained as in Example 1.

In Examples 2 and 3, the recovered acid was concentrated 3 times and 10 times, respectively, to set the same concentrations as the plating liquid composition. Thereafter, the recovered acid was used for dissolution of tin hydroxides or plating liquid regulation.

In Comparative Example 1, the plating liquid was passed through a chelate resin used in place of the cation exchange resin. Fe ions were not adsorbed, and remained in a recovered acid, resulting in failure to remove Fe ions. In Comparative Example 2, when the pH value of a sulfuric acid water solution which was obtained when the cation exchange resin was reproduced and which contains Fe ions was adjusted by using sodium hydroxide, the pH value was increased to 8 or greater, so that an iron hydroxide precipitate was generated along with a tin hydroxide precipitate, resulting in failure to separate tin and to remove Fe ions.

TABLE 2

| | NAME OF EXCHANGE RESIN |
|---|---|
| EXAMPLE 1 OF INVENTION | DIAION SK1B |
| EXAMPLE 2 OF INVENTION | DIAION SK1B |
| EXAMPLE 3 OF INVENTION | DIAION SK106 |
| EXAMPLE 4 OF INVENTION | DIAION SK1B |
| EXAMPLE 5 OF INVENTION | DIAION SK1B |
| COMPARATIVE EXAMPLE 1 | DIAION CR10 |
| COMPARATIVE EXAMPLE 2 | DIAION SK1B |

(Embodiment 2)

Fe ions and other cations in a tinning liquid were removed by using the system shown in FIG. 2. The tinning liquid contained i-propanolsulfonic acid, Sn ions, Fe ions and plating additives.

An amount of 0.1 $m^3$ of a mixture of the plating liquid and a dragged-out liquid (acid concentration: 0.5 kmol/$m^3$, acid amount (in sulfuric acid equivalent): 10 kg) was passed through cartridge filter 5 and was thereafter passed through 0.08 $m^3$ of a strong-acid cation exchange resin (Diaion SK1B, a product from Mitsubishi Kasei Corp.) at spatial velocity SV4 to remove cations. Ten (10) kg of a recovered acid was thereby obtained. The exchange resin to which cations were adsorbed was reproduced by passing 0.2 $m^3$ of a 10 w/v% of a sulfuric acid solution through the exchange resin. Oxygen was blown into an obtained sulfuric acid solution containing Sn ions and Fe ions (at a flow rate of 3 $m^3$/hr for 50 hours) to obtain 3.8 kg of a tin sludge ($SnO_2$) precipitate. The sludge was maintained in air at 600° C. for 1 hour to burn off impurities. Successively, the sludge was maintained in a reducing atmosphere (containing 10% hydrogen and the balance nitrogen) at 850° C. for 50 hours. Three (3.0) kg of stannous oxide and 0.3 kg of metal tin thereby formed was recovered. The mass of stannous oxide was pulverized into a powder, which was mixed and dissolved in the recovered acid to obtain 0.1 $m^3$ of a reproduced plating liquid.

Table 3 shows changes in the contents of Sn ions and Fe ions and the acid amount in the processed liquids, and Table 4 shows exchange resins used in this embodiment.

TABLE 3

| | BEFORE TREATMENT | | | COMPOSITION OF RECOVERED ACID | | | COMPOSITION OF LIQUID AFTER OXIDATION TREATMENT | |
|---|---|---|---|---|---|---|---|---|
| | $Sn^{2+}$ (kg) | $Fe^{2+}$ (kg) | ACID AMOUNT (kg) | $Sn^{2+}$ (kg) | $Fe^{2+}$ (kg) | ACID AMOUNT (kg) | $Sn^{2+}$ (kg) | $Fe^{2+}$ (kg) |
| EXAMPLE 6 OF INVENTION | 3 | 2 | 10 | 0 | 0 | 10 | 0 | 2 |
| EXAMPLE 7 OF INVENTION | 1 | 0.6 | 3.3 | 0 | 0 | 3.3 | 0 | 0.6 |
| COMPARATIVE EXAMPLE 3 | 3 | 2 | 10 | 0 | 2 | 10 | 0 | 2 |
| COMPARATIVE EXAMPLE 4 | 3 | 1.5 | 10 | | — | | 3 | 1.5 |

| | OXIDATION METHOD | AMOUNT OF REMOVED IRON (kg) | AMOUNT OF RECOVERED PLATING LIQUID ($m^3$) | AMOUNT OF RECOVERED STANNOUS OXIDE (kg) |
|---|---|---|---|---|
| EXAMPLE 6 OF INVENTION | OXYGEN BLOWING | 2.0 | 0.1 | 3.0 |
| EXAMPLE 7 OF INVENTION | HYDROGEN PEROXIDE ADDITION | 0.6 | 0.1 | 0.8 |
| COMPARATIVE EXAMPLE 3 | OXYGEN BLOWING | 0 | — | 3.0 |
| COMPARATIVE EXAMPLE 4 | OXYGEN BLOWING | 0 | — | — |

TABLE 4

| | NAME OF EXCHANGE RESIN |
|---|---|
| EXAMPLE 6 OF INVENTION | DIAION SK1B |
| EXAMPLE 7 OF INVENTION | DIAION SK102 |
| COMPARATIVE EXAMPLE 1 | DIAION CR10 |
| COMPARATIVE EXAMPLE 2 | — |

In each of Examples 6 and 7 of the invention, a diluted liquid of the plating liquid was passed through the cation exchange resin, and Fe ions and other cations were thereby removed efficiently to obtain a recovered acid. Also, 10% sulfuric acid was passed through the exchange resin to reproduce the exchange resin as well as to obtain a sulfuric acid water solution containing Sn ions and Fe ions. Further, oxygen gas was blown into this water solution or a hydrogen peroxide solution was added thereto to precipitate and separate Sn ions in the form of a tin sludge ($SnO_2$). The tin sludge was burnt in air to burn off impurities, and was reduced in a reducing atmosphere to recover tin almost entirely in the form of stannous oxide. The mass of stannous oxide was pulverized into a powder and was mixed and dissolved in recovered acid to obtain a reproduced plating liquid.

In Comparative Example 3, the plating liquid was passed through a chelate resin used in place of the cation exchange resin. Fe ions were not adsorbed, and remained in a recovered acid, resulting in failure to remove Fe ions. In Comparative Example 4, the plating liquid was directly oxidized with an intention to form a tin sludge. However, no sludge was formed because the oxidation was limited by an additive (antioxidant) in the plating liquid.

(Embodiment 3)

The operation of the process of the related art (disclosed in Japanese Patent Publication Nos. 57-53880 and 61-17920) and the process of the present invention was repeated ten times and the material balance in plating liquids was examined.

A cycle of sampling 0.1 $m^3$ of each plating liquid from a tin plating tank (1 $m^3$), removing Fe ions and other cations from the plating liquid by the corresponding method, and returning 0.1 $m^3$ of a reproduced plating liquid to the tank was repeated ten times. Table 5 shows the composition in the tank before and after the repeated operation. In the example of the present invention, only Fe ions in the plating liquid were removed and the plating liquid was suitably reproduced. In the case of Comparative Example 1 (related art disclosed in Japanese Patent Publication No. 57-53880), Fe ions were removed but excess acid used when Sn ions were recovered from the chelate resin was accumulated in the bath, so that the material balance in the bath was lost. In the case of Comparative Example 2 (related art disclosed in Japanese Patent Publication No. 61-17920), Fe ions were removed but all Sn ions were lost by electrolytic precipitation. Also, at the time of electrolysis, a part of plating additives was denatured and reduced by oxidation.

According to the present invention, a method effective in removing Sn ions, Fe ions and detrimental cations in a tinning liquid and in recovering and reproducing useful materials such as a plating electric conduction assistant and tin is provided. Therefore, the present invention contributes greatly to resource and energy saving and enables tinning facilities to be constructed in a closed system. Thus, the present invention is effective in limiting a renewal reduction in a plating liquid and ensuring environmental hygiene.

What is claimed is:

1. A method of recovering and reproducing a tinning liquid containing Sn ions and at least one of Fe ions and Cr ions, comprising the steps of:

a) absorbing Sn ions and at least one of Fe ions and Cr ions from tinning liquid by passing one of tinning liquid and a diluted tinning liquid through a strong-acid cation exchange resin to obtain a recovered acid;

b) thereafter reproducing the strong-acid cation exchange resin by passing another acid through the exchange resin to which the Sn ions and at least one of Fe ions and Cr ions had been absorbed and desorbing the absorbed Sn ions and at least one of Fe ions and Cr ions into a solution containing the another acid;

c) precipitating and separating Sn ions only in the form of a precipitate of a Sn compound containing tin hydroxide from the solution containing Sn ions and at least one of Fe ions and Cr ions obtained in the step (b) while maintaining Fe ions and/or Cr ions in the solution;

d) mixing and dissolving the precipitate of the Sn compound obtained in the step (c) when tin in the hydroxide is other than quadrivalent, or mixing and dissolving the precipitate of the Sn compound after reducing the same if tin in the hydroxide is quadrivalent, in the recovered acid obtained in the step (a) to reproduce the mixture of the Sn compound and the recovered acid as tinning liquid; and e) discharging the solution, obtained in the step (c) and containing Fe ions and/or Cr ions.

2. A method of recovering and reproducing a tinning liquid according to claim 1, wherein the concentration of the another acid passed through the strong-acid cation exchange resin in the step (b) is 10 to 30 w/v%.

3. A method of recovering and reproducing a tinning liquid according to claim 1, wherein an alkali is added to the solution containing Sn ions and at least one of Fe

TABLE 5

| | BEFORE TREATMENT | | | | AFTER 10-TIME CONTINUOUS OPERATION | | | |
|---|---|---|---|---|---|---|---|---|
| | $Sn^{2+}$ (g/L) | $Fe^{2+}$ (g/L) | ACID CONCENTRATION (SULFURIC EQUIVALENT) (g/L) | ADDITIVE CONCENTRATION (g/L) | $Sn^{2+}$ (g/L) | $Fe^{2+}$ (g/L) | ACID CONCENTRATION (SULFURIC EQUIVALENT) (g/L) | ADDITIVE CONCENTRATION (g/L) |
| EXAMPLE OF INVENTION | 30 | 15 | 50 | 5 | 29.8 | <0.1 | 50 | 5 |
| COMPARATIVE EXAMPLE 1 (JAPANESE PATENT PUB. NO.57-53880) | 30 | 15 | 50 | 5 | 29.5 | <0.1 | 130 | 5 |
| COMPARATIVE EXAMPLE 2 (JAPANESE PATENT PUB. NO.61-17920) | 30 | 15 | 50 | 5 | 0.2 | <0.1 | 50 | 2.3 (OXIDATION DENATURATION) |

ions and Cr ions and obtained in the step (b) to precipitate and separate Sn ions only.

4. A method of recovering and reproducing a tinning liquid according to claim 3, wherein upon addition of an alkali to the solution, the pH value of the solution is maintained at a value of 3 to 6.

5. A method of recovering and reproducing a tinning liquid according to claim 1, wherein the solution obtained in the step (b) and containing Sn ions and at least one of Fe ions and Cr ions is oxidized to precipitate and separate Sn ions only.

6. A method of recovering and reproducing a tinning liquid according to claim 1, wherein the tinning liquid contains Sn ions and Fe ions.

7. A method of recovering and reproducing a tinning liquid according to claim 1, wherein the tinning liquid contains Sn ions and Cr ions.

8. A method of recovering and reproducing a tinning liquid according to claim 1, wherein the tinning liquid contains Sn ions, Fe ions and Cr ions.

* * * * *